United States Patent [19]

Yannopoulos

[11] 4,274,870

[45] Jun. 23, 1981

[54] SMELTING OF COPPER CONCENTRATES BY OXYGEN INJECTION IN CONVENTIONAL REVERBERATORY FURNACES

[75] Inventor: John C. Yannopoulos, Danbury, Conn.

[73] Assignee: Newmont Exploration Limited, Danbury, Conn.

[21] Appl. No.: 33,208

[22] Filed: Apr. 25, 1979

[51] Int. Cl.[3] ..... C22B 15/00

[52] U.S. Cl. ..... 75/73; 75/23

[58] Field of Search ..... 75/72–76, 75/23

[56] References Cited

U.S. PATENT DOCUMENTS

| | | | |
|---|---|---|---|
| 2,506,598 | 5/1950 | Johnson Jr. | 266/226 |
| 3,459,415 | 8/1969 | Holeczy | 75/73 |
| 3,645,520 | 2/1972 | Acre et al. | 266/225 |

*Primary Examiner*—M. J. Andrews

*Attorney, Agent, or Firm*—Pennie & Edmonds

[57] ABSTRACT

A process for the modification to existing and conventional reverberatory furnaces for smelting copper concentrates in such furnaces, for improving the thermal efficiency of the furnace and for achieving an increased concentration of $SO_2$ in the gas emanating from the furnaces, by the use of specially designed lancing assembly.

9 Claims, 4 Drawing Figures

SMELTING OF COPPER CONCENTRATES BY OXYGEN INJECTION IN CONVENTIONAL REVERBERATORY FURNACES

BACKGROUND OF THE INVENTION

1. Field of Invention

This invention relates to modifications to conventional and existing reverberatory furnaces and to a new process for smelting copper concentrates in such furnaces for the production of matte—a semi-finished product—and of a furnace gas with high sulfur dioxide ($SO_2$) content and for improving the thermal efficiency in such furnaces.

2. Description of the Prior Art

The smelting of copper concentrates has been performed in reverberatory furnaces for a very long time. Copper concentrates are charged in a reverberatory furnace either after roasting (calcine smelting) or as wet (5–10% moisture) concentrates (green charge smelting). The present discussion is restricted to green charge reverberatory smelting since the process of the invention may be applied to green (non-roasted) copper concentrates, and particularly because this invention describes a novel method of smelting copper concentrates in conventional and existing reverberatory furnaces which are modified accordingly.

A typical copper smelting reverberatory furnace is 100 to 120 ft. long, 28 to 36 ft. wide, and 13 to 15 ft. high, with a suspended roof composed of refractory bricks. At one end of the furnace powerful burners (natural gas, or fuel oil, or pulverized coal) supply highly heated products of combustion which melt the charge. The hot gases leave the furnace at the other end—opposite the burners—and flow through an uptake and through special waste-heat recovery boilers. As a rule, there are two waste heat boilers per furnace. Charging hoppers with water-cooled ducts through the roof and along the side walls of the furnace feed the process with wet concentrate mixed with the appropriate fluxes. The charge forms banks along the walls. The surface of the banks is exposed to the intense heat and smelts slowly. The charge melts into matte—a semi-finished product containing mainly cuprous sulfide ($Cu_2S$) and ferrous sulfide (FeS)—and slag, containing the fluxed oxidized and refractory impurities of the concentrate. Due to the difference in specific gravity, the matte settles under a layer of slag. The slag, with low content of copper, is skimmed close to the uptake of the furnace and is rejected. Matte is tapped from tap-holes (below the slag) into ladles and transported into special oxidizing furnaces, the converters. In the converters, matte is blown with air in the presence of silica flux. The iron and sulfur of the matte are oxidized to iron silicate slag and gaseous sulfur dioxide, and impure copper—called blister—is produced. The converter slag has a high copper content and is returned to the reverberatory furnace for cleaning. Reverberatory furnaces are equipped with one or two refractory launders for the recycling of the converter slag.

Only the unstable labile sulfur (from chalcopyrite, bornite, covellite, pyrite, etc.) is evolved by thermal decomposition and oxidized in the reverberatory furnaces, since the process is conducted under slightly oxidizing—almost neutral—conditions.

Reverberatory furnaces are thermally very inefficient with only 20–22% of the heat input consumed for smelting and the rest of the heat dissipated as sensible heat of voluminous combustion gaseous products and as extensive wall losses. A very significant consumption of fuel is required for green charge reverberatory smelting (6.0 to 9.0 million Btu's per ton of concentrate). In spite of the combustible nature of the sulfur and iron, that are contained in the charge, a typical reverberatory consumes 6 to 9 billion Btu's per day. The massive use of fossil fuels, in direct combustion within the furnace, is a huge waste of energy and creates voluminous combustion gases that dilute the gaseous products of smelting and, therefore, the furnace gas has a very low content of $SO_2$ (1.0 to 2% at the uptake). This gas is further diluted by air infiltration in the boilers, flues and electrostatic percipitators and contains at the end 0.2 to 0.9% $SO_2$. Very significant quantities of sulfur (up to 100 tons per furnace day) are emitted from copper smelting reverberatory furnaces. The very low content of $SO_2$ in the reverberatory gas requires prohibitively high capital and operating cost for the control of the sulfur emission. The very high cost of controlling this sulfur emission and the very low thermal efficiency are the main drawbacks of conventional and existing reverberatory smelting.

Oxygen has been used in reverberatory furnaces mostly as oxygen enrichment of the combustion air. With the use of oxygen, the thermal efficiency of the furnace and its smelting rate have increased by 15 to 30%.

Oxy-fuel burners (combusting fuel with oxygen) firing through the roof on the banks of the charge have been also used in reverberatories and have improved the thermal efficiency and the production rate of the process. These improvements, nevertheless,—in spite of the modest increase in smelting rate—do not achieve furnace gas with high $SO_2$ content.

There are new copper smelting processes—applied and proposed—which have significantly higher thermal efficiency than reverberatory furnaces and which produce gas with high content of $SO_2$ amenable to pollution control. For instance, Morisaki et al U.S. Pat. No. 3,725,044 discloses a continuous method for the processing of sulfide ores by the use of a succession of distinct and uninterrupted unit furnaces which are in series to each other. Two or three furnaces are used. Although the Morisaki patent aims at achieving improved thermal efficiency as well as increasing the sulfur dioxide concentration in the waste gas, the method of the patent is described as "distinctly different" from conventional copper extraction methods including specifically reverberatory furnaces. The methods of the patent are of no possible benefit to achieving the same results in existing reverberatory furnaces which operate in a totally different manner and under relatively discontinuous batch-wise conditions. In the same manner, Worner U.S. Pat. Nos. 3,326,671 and 3,463,472 aim for producing metals directly from particulate ores and concentrates by the application of the method of the patents to a unique and integrated apparatus which, by the very nature of the method, precludes the use of this method for modifying existing reverberatory furnaces to obtain either improved thermal efficiency or an increased concentration of sulfur dioxide in the waste gas. Similarly, Holeczy et al U.S. Pat. No. 3,459,415 teaches the use of an "improved and specially designed apparatus" which directly produces converter copper.

All such new processes require in effect the complete abandonment of existing reverberatory furnaces and of most of the associated smelting equipment. Yet a number of reverberatory furnaces are in good operating condition and often better suited than the new processes for smelting contaminated copper concentrates. Replacement of operating reverberatory smelters by any of the new smelting processes is a very expensive proposition. The modification of existing reverberatory furnaces, as described by the present invention, can decrease very significantly their energy requirements and increase very substantially the $SO_2$ content of the furnace gas.

SUMMARY OF THE INVENTION

This invention relates to modification of conventional and existing copper smelting reverberatory furnaces and particularly to a new process for the forceful injection of the copper concentrate charge admixed with oxygen—or oxygen enriched air—into the bath of those modified reverberatory furnaces through specially designed lances.

This invention relates to a process for the production of copper matte from finely-divided sulfidic iron-bearing copper concentrates by smelting in a conventional reverberatory furnace, for increasing the thermal efficiency of such furnace and for increasing the concentration of sulfur dioxide in the gas emanating from such furnace, which comprises establishing a molten cupriferous bath in such furnace, disposing a plurality of lances vertically through the furnace roof adjacent the end of the furnace opposite the flue, the discharge end of each lance being positioned closely adjacent the surface of the molten bath, projecting a stream of said concentrates admixed with slag-forming agents together with a current of substantially pure oxygen through said lances with sufficient force to agitate the bath, whereby said concentrates are smelted to form matte and slag in the bath, maintaining the molten bath relatively quiescent in that portion of the furnace adjacent the flue, and withdrawing matte and slag separately from the bath where it is relatively quiescent.

Smelting and partial converting take place within the molten splashing bath due to the highly oxidizing conditions. The heat generated by the partial oxidation of sulfur and iron is used—in place—for smelting, thus decreasing very significantly the fuel requirements of the process and of course increasing thermal efficiency of the furnace. Due to the increased thermal efficiency of the furnace and the tremendous decrease in the volume of the furnace gas, high production rate and product gas with very high sulfur dioxide content are achieved.

The modification of existing or conventional copper smelting reverberatory furnaces comprises the injection with oxygen—or oxygen enriched air—of dry concentrates admixed with fluxes into the agitated bath of the furnace. Lances, coming down through the furnace roof and with their tips close to the bath, inject the charge with oxygen—or oxygen enriched air—into the furnace bath. The burning charge merges with the splashing bath and smelting reactions occur. The furnace is divided into a smelting zone—where the lancing, smelting, and partial converting of the charge occur—and a settling zone where the products of smelting—matte and slag—are separated.

The invention also relates to a process for treating the withdrawn slag material to produce a copper concentrate which is recycled to the reverberatory furnace.

The ratio of oxygen/concentrate is regulated to produce high grade matte (50–70% Cu). Since sufficient heat is generated in the smelting zone of the modified reverberatory furnace particularly by the sulfide and iron oxidizing reactions, the fuel requirements of the new process are very small. The process is almost autothermal and saves significant fuel energy. Auxiliary burners are added to the reverberatory furnace and provide some supplementary heat to the settling zone.

The restricted volume of combustion gases and the absence of nitrogen create a small flow rate of furnace gas, pursuant this invention, and allow a very high smelting rate which yields high content of sulfur dioxide in the furnace emission. The furnace gas, with more than about 20% $SO_2$, is amenable to low cost production of sulfuric acid and hence low cost control of the sulfur emission.

Existing copper smelting reverberatory furnaces can be modified with only minor cost and operated according to this new smelting process. The new smelting process is expected to have lower operating cost than the conventional smelting in reverberatories due to an increased smelting rate and the savings in fuel consumption. The control of the furnace sulfur emission is both technically feasible and of low cost because the high content of sulfur dioxide in the effluent gas.

BRIEF DESCRIPTION OF THE DRAWINGS

The new process for smelting copper concentrates with oxygen in modified existing and conventional reverberatory furnaces will be better understood from the following description in conjunction with the accompanying drawings, of which.

DESCRIPTION OF THE PREFERRED EMBODIMENTS

The charge to the furnace is composed of fine concentrate mixed with the appropriate fluxes. The charge has to be thoroughly dried to a moisture content of less than about 1% by weight. Drying can be done in a rotary kiln, or preferably spray drier or fluidized bed drier, depending on the conditions and the layout of the particular smelter. Drying by either spray drier or fluidized bed drier are the preferred methods of drying.

Figure 1A:
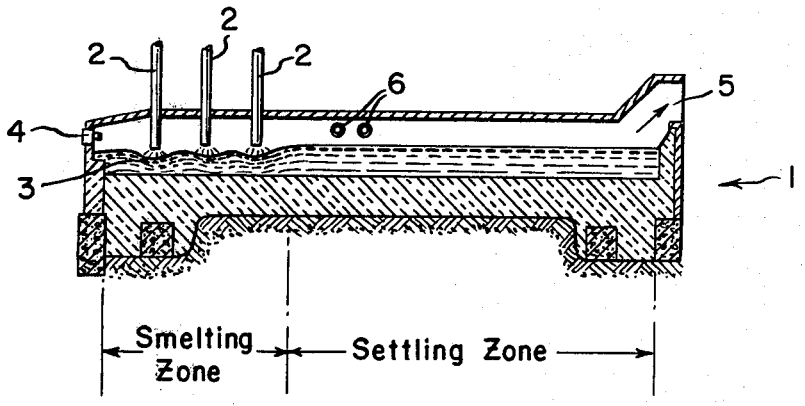
FIG. 1(A) is a schematic drawing of a longitudinal sectional view of a modified conventional reverberatory furnace, showing the position of the lances in the smelting zone.
Figure 1B:
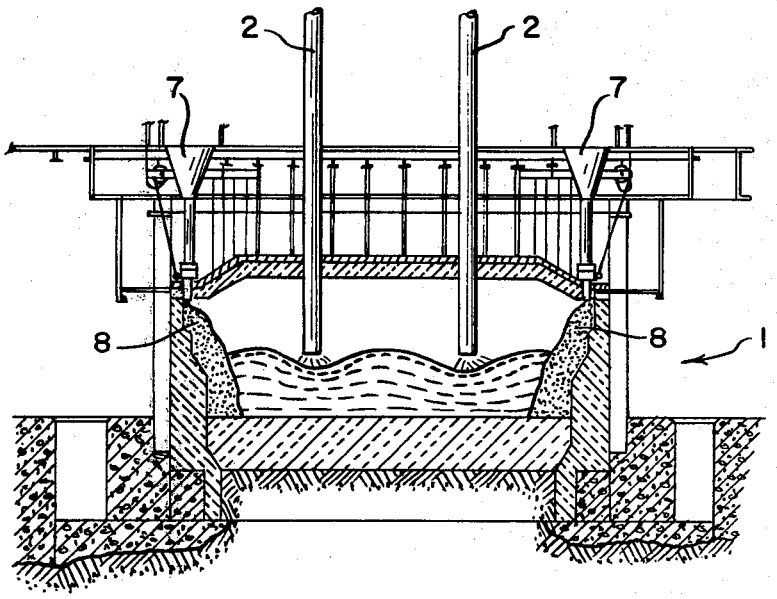
FIG. 1(B) is a schematic drawing of a cross sectional view of the smelting zone of a modified conventional reverberatory furnace also showing the position of the lances in the smelting zone.

The bone-dry charge is pneumatically transported to either surge bins or directly to the charging hoppers. Specially designed lances which are disposed downwardly through the furnace roof with their tips relatively very close to the bath surface, pneumatically inject the charge with oxygen or oxygen enriched air into the bath, as shown in FIG. 1. Referring to FIG. 1(A), there is schematically depicted the longitudinal section of a conventional reverberatory furnace (1) which is shown to contain a smelting zone and a relatively quiescent settling zone (particularly quiescent adjacent the gas uptake portion (5) and the matte and slag withdrawal points, not shown). Disposed through the roof of the furnaces are lance assemblies (2) whose lower tips are shown positioned adjacent the surface of the molten bath (3). Also shown are the burners (4), which are typically located at the front end of the smelting zone of the furnace and which will generally remain idle during operation in accord with the instant process, the gas uptake portion of the flue (5) of the furnace, being located at the terminal and downstream end of the smelting zone of the furnace, as well as the auxiliary burners (6) which will be added to the furnace in the practice of this invention. With reference to FIG. 1(B), there is schematically depicted a cross section of a conventional reverberatory furnace (1) having disposed through the roof thereof the lance assemblies (2). Also shown thereon are the fettling hoppers (7) disposed through the roof of the furnace and the fettling banks (8) within the furnace.

The pressure of the oxygen and the distance of the tips of the lances from the bath are regulated to create a vigorous agitation of the molten mass, to maximize oxygen efficiency and to minimize the consumption of the lance. The impingement velocity of the charge particles—at the tip of the lance—is high enough to merge the charge into the molten splashing bath, and any significant proportion of flying dust is avoided. It is desireable that the bath adjacent to the flue or gas uptake area of the furnace—i.e., the settling zone, be maintained under relatively quiescent conditions and that the matte and slag also be withdrawn from the relatively quiescent section of the furnace. Quiescent conditions are obtained by locating the lances within the smelting zone and sufficiently spaced apart from the gas uptake area and the matte and slag withdrawal points.

A number of lances, depending on the size of the existing furnace and the smelting rate, are installed within the first third of the reverberatory furnace—the smelting zone of the furnace, as shown in FIG. 1. The preferred number of lances is six, five in operation and one installed spare, ready to go.

The design or the material of construction of the lances is not restrictive to the concept of the present invention. Plain consumable steel pipes, pipes cooled by water or organic media circulation, refractory material pipes or steel pipes protected by castable refractory, can perform the lancing.

Figure 2:
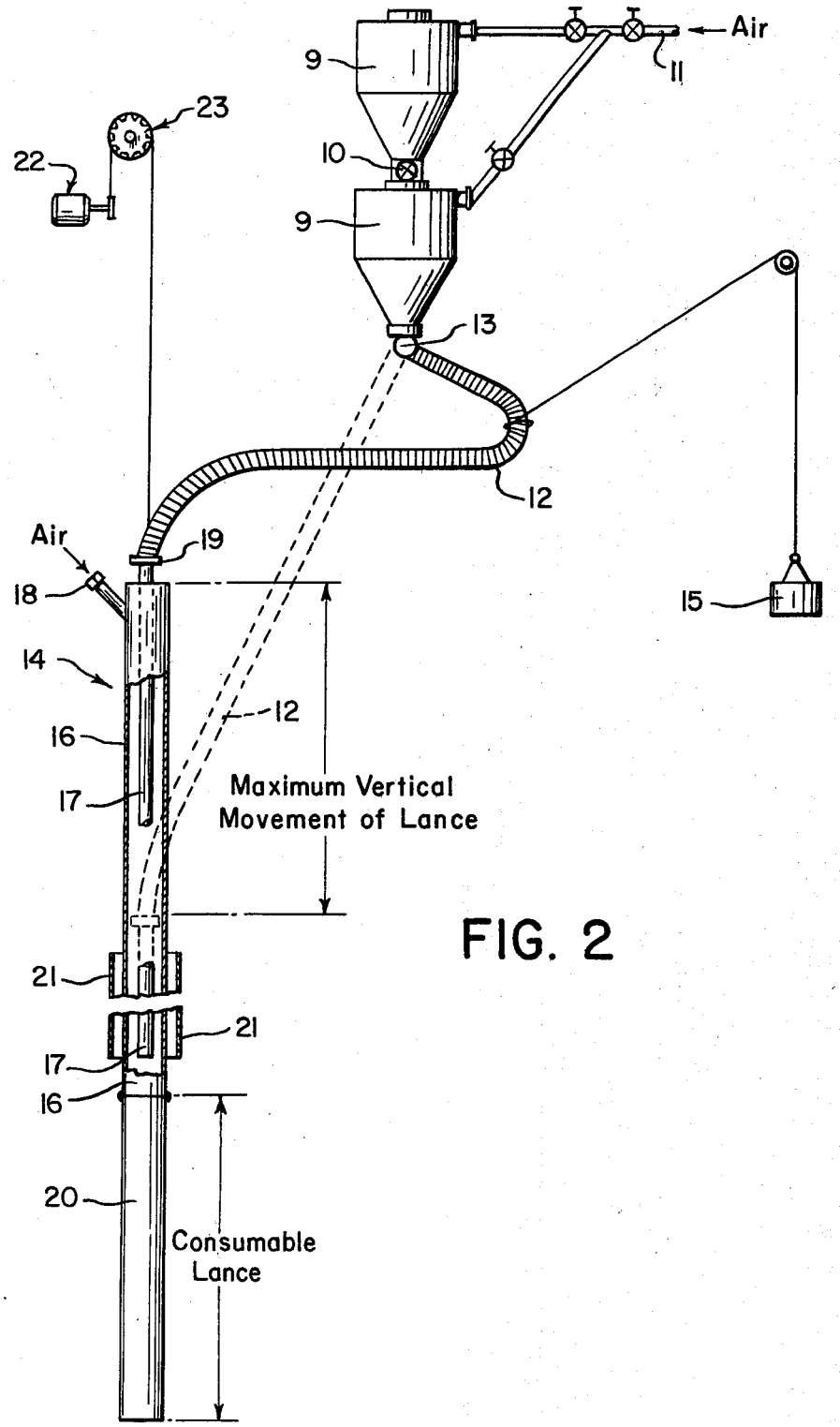
FIG. 2 is a schematic drawing of a lancing assembly through which the dry charge is injected with oxygen or oxygen enriched air into the bath of the smelting zone of a modified conventional reverberatory furnace.

The preferred consumable and extractable lancing assembly is depicted in FIG. 2. Each assembly has its own external pressurized chamber, shown as twin-chamber hopper (9). Charge flows from the top of the bottom chamber at constant pressure. With an intermediate valve (10) between the chambers, the upper chamber can be isolated, filled at atmospheric pressure and then closed and pressurized with oxygen enriched air via air inlet (11). A flexible connecting means (12), preferably a flexible steel pipe—of adequate length—connects the outlet (13) of the chamber to the inlet to the lance assembly (14), and particularly to the inlet (19) of the concentric inner pipe shown as inner pipe (17) (1.5 to 2 inches in diameter). The length of the flexible steel pipe is such as to allow the lance assembly to move vertically. A counter-weight (15) balances the flexible steel pipe in a flow position. The lance assembly is also composed of a supporting pipe shown as an outer pipe (16) (3 to 4 inch diameter) which is connected to the consumable pipe, shown as outer pipe (20), through which the concentrate/oxygen charge is discharged. The outer pipe is connected with an oxygen or oxygen enriched air inlet port (18). The slow pneumatic conveying of the charge through the inner pipe restricts the abrasion of the concentric inner pipe.

The lower portion of the consumable discharge pipe (20) is expected to be consumed, starting from the tip, due to oxidation and thermal erosion. The lance assembly in operation moves slowly downward—within a guiding assembly shown as guiding pipe (21)—under the force of its own weight. A means for controlling the upward-downward movement, shown as a gear mechanism (23) coupled with a variable speed motor (22), controls the slow movement of the lance assembly to approximately match its rate of consumption.

Figure 3A:
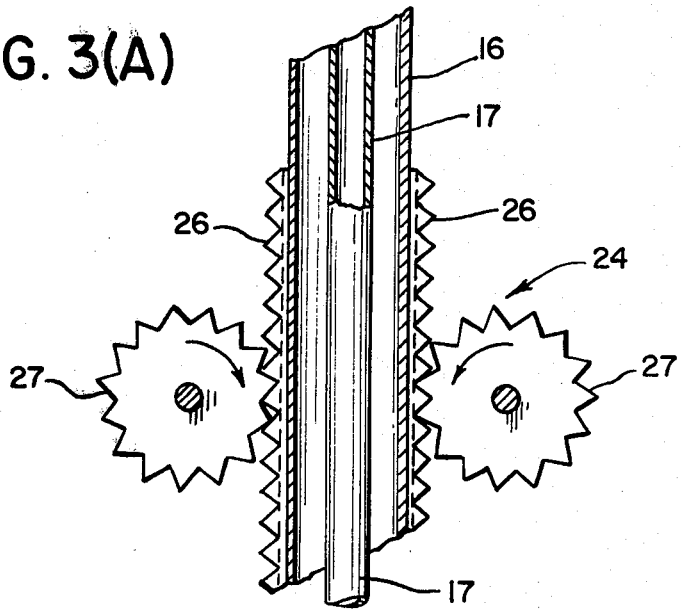
FIG. 3(A) is a sectional front view of the mechanism which prevents the upward movement of the lance assembly during operation.
Figure 3B:
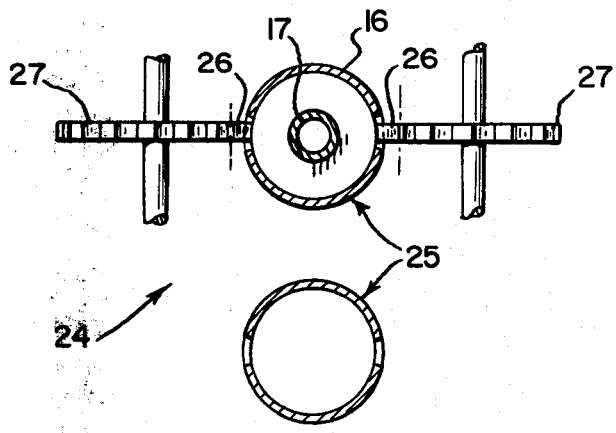
FIG. 3(B) is a top plan view thereof.

The guiding assembly mechanisms (24) depicted in FIGS. 3(A) and 3(B) prevent the upward movement of the lance assemblies during operation. A section of a pipe (25) with a diameter approximately ½ inch larger than the diameter of the outer pipe of the lance assembly, is rigidly installed above the roof of the furnace in a vertical position and acts as a guide to the movement of the lance assembly. The upper portion of the guiding pipe is split across its diameter allowing approximately 1-inch thick indented guides (26) to move along the lance assembly. Upward movement of the lance assembly is prevented by two cogged wheels (27) with controlled direction of rotation as by the use of a restraining ratchet assembly (not shown) which are installed in close proximity to the top of the guiding pipe.

The flexible pipe and the inner pipe are 316 stainless steel, whereas the lower consumable part of the outer pipe is 446 stainless steel, although the materials of construction are not limited to those steels.

When the consumable part (20) of the lance assembly has burnt, feeding through this particular lance is stopped. The spare installed lance-assembly is activated. The consumed lance is replaced with another complete lance by coupling the latter to the oxygen inlet port (18), to the flexible feed pipe (12), and to the movement control mechanism (22) and (23). The spent lance is renovated by welding the proper length of stainless steel pipe to its outer pipe. Variations from the preferred lance assembly shown in FIG. 2, as would be readily apparent to one skilled in the art, are contemplated as within the scope of the present invention.

The ratio of oxygen/concentrate is regulated to produce high grade copper of matte (about 50 to 70% Cu). The required heat for smelting is generated by the oxidizing reactions within the lancing zone of the furnace. The molten bath acts as a heat and oxygen sink and as a heat and mass transfer medium causing a smelting of the charge with its splashing.

The furnace side walls should preferably be fettled with relatively high banks of siliceous charge along the first half of the furnace. This fettling, although not absolutely necessary, may be required for the protection of the side walls from the intense heat of the smelting zone. The amount of fettling material to be charged may be easily determined depending largely upon furnace operation. It is intended that this fettling material will subsequently also be smelted at a very slow rate.

Since the main supply of the heat is obtained from the partial oxidation of the sulfur and iron of the charge in the smelting zone, the front end burners of the reverberatory furnace remain idle during normal operation. Those burners can be activated during the warm-up of a new furnace, or in emergencies when charging to the furnace has to be restricted or stopped. About two to four additional burners are installed through the sidewalls, close to the roof, and downstream of the smelting (lancing) zone between the lances and the flue. These burners provide supplementary heat to the settling zone of the furnace during operation.

The last two-thirds of the furnace, downstream of the lances, is the settling zone where matte and slag are separated. Slag—high in copper content—must be skimmed regularly and frequently to maintain a thin layer within the furnace. The matte is transferred to the converters, as in the conventional smelting process.

Notwithstanding the relatively quiescent conditions in the area where the slag is withdrawn, it has been found that, owing probably to the agitation of the bath in the area of the lances, the slag material contains a substantial amount of copper which, unlike in the case of conventional smelting where the slag of the reverberatory furnace is rejected, makes it economical to attempt to recover this copper value.

To this end, the present invention also contemplates a method for treating the slag product of the reverberatory furnace whereby the withdrawn slag is first slowly cooled and solidified and thereafter it is subjected to a froth flotation treatment step whereby there is removed from the slag a tailings product containing impurities so as to yield a sulfidic iron-bearing copper concentrate product. This regenerated concentrate product is then recycled and combined with the new concentrate as the feed material to the reverberatory furnace. Preferably the cooled and solidified slag is ground to a froth flotation size before subjecting it to the froth flotation treatment step. The treatment of the slag material and the recycle of the resulting concentrate product are depicted schematically in FIG. 4.

Figure 4:
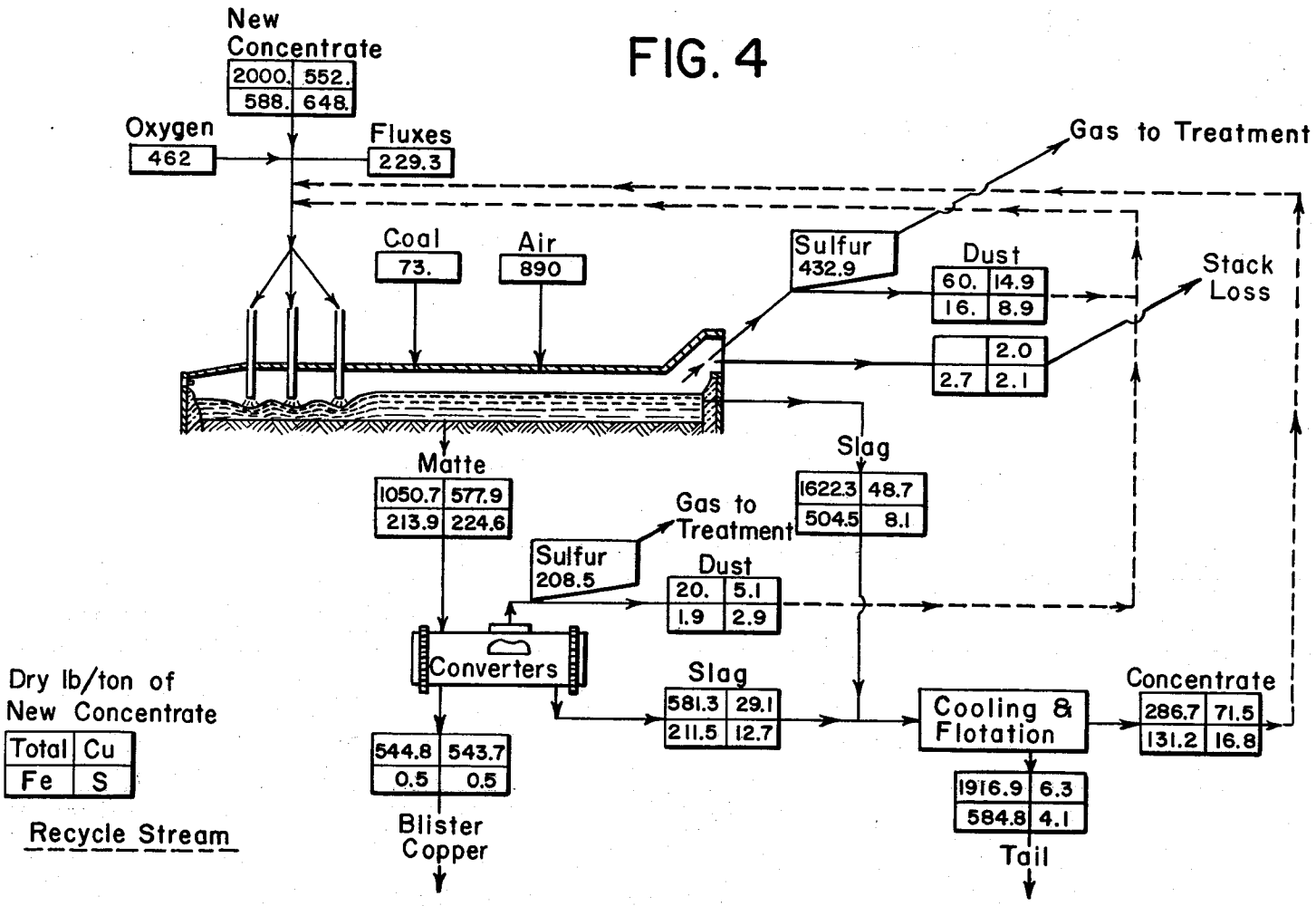
FIG. 4 is a material flow balance realized by the application of this invention and also depicts the process for treating the withdrawn slag to produce a copper concentrate which is recycled to the furnace.

It is also contemplated that in an overall copper producing process that the slag withdrawn from the converter(s) furnace employed to produce blister copper would be combined with the withdrawn reverberatory slag and then processed as described to yield the recycled concentrate (see FIG. 4).

The conditions under which the withdrawn slag material is cooled is not critical, the only requirement being that such cooling be done relatively gradually, preferably by allowing the slag to cool slowly and naturally under ambient conditions to substantially ambient temperatures. The withdrawn slag should not be suddenly cooled as by quenching and in this regard the handling of the slag product in accord with this invention differs from conventional slag processing particularly from those that quench the slag and thereafter reject it. Similarly, the conditions under which the cooled slag is then subjected to the froth flotation treatment step, preferably after it is first ground to an approximate size, are not critical and any of such conditions as, for instance, are normally practiced in the froth flotation treatment of sulfidic copper containing material to produce a copper concentrate and which are generally well known to those skilled in the art may be employed.

By the processing of the withdrawn slag, substantially improved recovery of copper is realized.

Since smelting by injection with oxygen—under restricted fuel combustion—decreases drastically the flow rate of the furnace gas, the smelting rate can be substantially increased. A very significant fraction of the sulfur contained in the charge is oxidized during smelting and partial converting in the reverberatory furnace. The resulting low volume of furnace effluent gas contains a substantial $SO_2$ concentration. The control of such sulfur emission (high in $SO_2$) is technically feasible and economically competitive. $SO_2$ concentrations above about 20% are achievable by the practice of this invention.

The following specific example of a material and heat balance is illustrative, but not limitative, of the production of high grade matte by oxygen injection of chalcopyrite concentrate in a conventional reverberatory furnace pursuant to the invention.

EXAMPLE 1

Fifteen hundred (1500) tons per day of chalcopyrite concentrate, together with 215 tons per day of concentrate resulting from slag treatment, and having the following composition are charged to a reverberatory furnace:

| | Chalcopyrite Conc. (1500 TPD) | Slag Conc. (215 TPD) | Feed (1,715) |
|---|---|---|---|
| Cu | 27.6% | 24.9% | 27.3% |
| Fe | 29.4 | 45.8 | 31.5 |
| S | 32.4 89.4 | 5.9 76.6 | 29.1 87.9 |
| $SiO_2$ | 6.1 | 19.0 | |
| $Al_2O_3$ | 2.1 | 2.1 | |
| Zn | 0.78 | | |
| Pb | 0.04 | | |
| CaO | 0.29 | 0.3 | |
| MgO | 0.2 | 0.2 | |
| $MoS_2$ | 0.07 | | |
| Trace Elements | 1.92 | | |
| | 100.00 | | |
| $CuFeS_2$ | 79.7% | — | 69.7% |
| $Cu_2S$ | — | 29.3% | 3.7 |
| $FeS_2$ | 5.7 | — | 5.0 |
| FeS | 4.0 | | 3.5 |
| | 89.4 | | |

Pulverized fluxes, of the following composition, are mixed with the concentrates:

| | Silica Flux (52 TPD) | Limestone Flux (120 TPD) |
|---|---|---|
| $SiO_2$ | 92.0 | 10.0 |
| CaO | 0.2 | 48.3 |
| $Al_2O_3$ | 2.6 | |
| FeO | 1.6 | |
| $CO_2$ | | 38.8 |

The complete material balance per ton of new metal-bearing concentrate is given in FIG. 4. Overall copper recovery is 98.5% after treatment of the reverberatory and converter slags by flotation. The ratio oxygen/charge is controlled (0.183 ton oxygen/ton charge, or 0.231 ton oxygen/ton new concentrate) to produce a matte with 55% Cu. The reverberatory slag, with 3%, Cu, 35% $SiO_2$, 10% $Fe_3O_4$, is slowly cooled and along with the converter slag is treated in a flotation plant.

About 67% of the new sulfur input is oxidized in the reverberatory furnace and the gas at the uptake has a high concentration of $SO_2$:

| Uptake gas: | |
|---|---|
| $SO_2$ | 23.1% |
| $CO_2$ | 16.9 |
| $N_2$ | 52.6 |
| $H_2O$ | 5.9 |
| $O_2$ | 1.5 |
| | 100.00 |

A heat balance of the reverberatory furnace operating at 1500 tons of new metal-bearing concentrate per day—injected with 98% oxygen—indicates the following:

| | | |
|---|---|---|
| Heat input: | | |
| Heat of reactions | 2.06 | MM-Btu/ton new conc. |
| Heat output: | | |
| Heat of fusion and evaporation | 0.09 | " |
| Heat in molten products | 1.33 | " |
| Heat in reaction gas and dust | 0.51 | " |
| Wall heat loss | 0.50 | " |
| Total | 2.43 | " |
| Heat to be supplied by fuel: | 0.37 | " |

With pulverized coal of a low heating value of about 12,100 Btu/lb, about 58% of the combustion heat is lost as sensible heat of the combustion gases and therefrom the fuel requirement is as follows:

| | | |
|---|---|---|
| 0.37/0.42 | = | 0.88 MM-Btu/ton new conc. |
| or | | |
| | | 73 lb coal/ton new conc. |

With oxygen production at 1.23 MM-Btu/ton, the total energy input into the furnace is:

| | |
|---|---|
| Fuel | 0.88 MM-Btu/ton new conc. |
| Oxygen (0.231 ton/ton) | 0.28 MM-Btu/ton new conc. |
| | 1.16 MM-Btu/ton new conc. |

The foregoing represents a very significant saving in the consumption of energy for smelting, since the same concentrate requires about 8.1 MM-Btu/ton in a green charge reverberatory furnace. In the latter case, 32% Cu matte is produced which requires more extensive handling and converting than does the high grade matte obtained by the practice of this invention. The high concentration of $SO_2$ in the furnace gas yields yet additional energy savings during its processing for control of the furnace sulfur emission.

I claim:

1. A process for the production of copper matte from finely-divided sulfidic iron-bearing copper concentrates by smelting in a conventional reverberatory furnace, for increasing the thermal efficiency of such furnace and for increasing the concentration of sulfur dioxide in the gas emanating from such furnace, which comprises establishing a molten cupriferous bath in such furnace, disposing a plurality of consumable lances vertically through the furnace roof adjacent the end of the furnace opposite the flue, the discharge end of each lance being positioned adjacent the surface of the molten bath, and wherein each lance is mounted for downward movement at substantially the rate at which its lower end is consumed in consequence of its proximity to the molten bath, and for retraction to above the furnace roof for repair when its lower end has been consumed, projecting a stream of said concentrates admixed with slag-forming agents together with a current of substantially pure oxygen through said lances with sufficient force to agitate the bath, whereby said concentrates are smelted to form matte and slag in the bath, maintaining the molten bath relatively quiescent in that portion of the furnace adjacent the flue, and withdrawing matte and slag separately from the bath where it is relatively quiescent.

2. The process according to claim 1 wherein the concentrates are smelted substantially entirely by the heat of oxidation of the sulfide and iron components of the concentrates.

3. The process according to claim 1 wherein the conventional reverberating furnace has added thereto from about 2–4 burners located close to the roof and between the lances and the flue.

4. The process according to claim 1 wherein the concentrates admixed with slag-forming agents are dried to a moisture content of less than about 1% by weight.

5. The process according to claim 1 wherein the total number of mounted lances is six.

6. The process according to claim 1 wherein the ratio of oxygen to concentrate is regulated to produce a high grade copper matte of from about 50–70% copper.

7. The process according to claim 1 wherein the concentration of $SO_2$ emanating from the reverberatory furnace is above about 20%.

8. The process according to claim 1 which comprises treating the withdrawn matte for recovery of its copper content by allowing the withdrawn slag to slowly solidify and cool, grinding the solidified slag and thereafter subjecting it to a froth flotation treatment step to recover its copper content in a sulfidic iron-bearing secondary copper concentrate product, and recycling said secondary concentrate to the reverberatory furnace for recovery of copper.

9. The process according to claim 8 wherein the withdrawn slag is first combined with the slag obtained from a converter furnace employed to produce blister copper.

* * * * *